US011891680B2

(12) United States Patent
Otome et al.

(10) Patent No.: US 11,891,680 B2
(45) **Date of Patent: *Feb. 6, 2024**

(54) STEEL MATERIAL SUITABLE FOR USE IN SOUR ENVIRONMENT

(71) Applicant: NIPPON STEEL CORPORATION, Tokyo (JP)

(72) Inventors: Yohei Otome, Tokyo (JP); Hiroki Kamitani, Tokyo (JP); Atsushi Soma, Tokyo (JP); Taro Oe, Tokyo (JP); Nobuaki Komatsubara, Tokyo (JP); Yuji Arai, Tokyo (JP); Hideki Takabe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 297 days.

This patent is subject to a terminal disclaimer.

(21) Appl. No.: 17/414,727

(22) PCT Filed: Feb. 13, 2020

(86) PCT No.: PCT/JP2020/005642

§ 371 (c)(1),
(2) Date: Jun. 16, 2021

(87) PCT Pub. No.: WO2020/166675

PCT Pub. Date: Aug. 20, 2020

(65) Prior Publication Data

US 2022/0042148 A1 Feb. 10, 2022

(30) Foreign Application Priority Data

Feb. 15, 2019 (JP) ..... 2019-025200

(51) Int. Cl.
*C22C 38/32* (2006.01)
*C21D 8/10* (2006.01)
(Continued)

(52) U.S. Cl.
CPC ..... *C22C 38/32* (2013.01); *C21D 1/25* (2013.01); *C21D 8/105* (2013.01); *C22C 38/005* (2013.01);
(Continued)

(58) Field of Classification Search
CPC ..... C22C 38/32
See application file for complete search history.

(56) References Cited

U.S. PATENT DOCUMENTS

2007/0137736 A1 6/2007 Omura et al.
2011/0315276 A1 12/2011 Bosch et al.
(Continued)

FOREIGN PATENT DOCUMENTS

JP 59232220 A 12/1984
JP 62253720 A 11/1987
(Continued)

*Primary Examiner* — Jophy S. Koshy
(74) *Attorney, Agent, or Firm* — Greer, Burns & Crain, Ltd.

(57) ABSTRACT

A steel material according to the present disclosure has a chemical composition consisting of, in mass %: C: 0.15 to 0.45%, Si: 0.05 to 1.00%, Mn: 0.01 to 1.00%, P: 0.030% or less, S: 0.0050% or less, Al: 0.005 to 0.100%, Cr 0.55 to 1.10%, Mo: 0.70 to 1.00%, Ti: 0.002 to 0.020%, V: 0.05 to 0.30%, Nb: 0.002 to 0.100%, B: 0.0005 to 0.0040%, N: 0.0100% or less, O: less than 0.0020%, and the balance being Fe and impurities, and satisfying Formula (1) described in the specification. A grain diameter of a prior-austenite grain is 15.0 μm or less, and an average area of precipitate which is precipitated in a prior-austenite grain boundary is $12.5\times10^{-3}$ $\mu m^2$ or less. A yield strength is 758 to 862 MPa.

10 Claims, 1 Drawing Sheet

F1

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/40*** | (2006.01) |
| ***C21D 1/25*** | (2006.01) |
| ***C22C 38/44*** | (2006.01) |

(52) U.S. Cl.

CPC ..... *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/40* (2013.01); *C22C 38/44* (2013.01); *C21D 2211/001* (2013.01)

(56) References Cited

U.S. PATENT DOCUMENTS

| | | | | |
|---|---|---|---|---|
| 2014/0352836 | A1* | 12/2014 | Eguchi | C21D 9/085 148/593 |
| 2022/0098712 | A1* | 3/2022 | Kamitani | C22C 38/001 |

FOREIGN PATENT DOCUMENTS

| | | | |
|---|---|---|---|
| JP | 06322478 | A | 11/1994 |
| JP | 08311551 | A | 11/1996 |
| JP | 2000256783 | A | 9/2000 |
| JP | 2000297344 | A | 10/2000 |
| JP | 2005350754 | A | 12/2005 |
| JP | 2012026030 | A | 2/2012 |
| JP | 2012519238 | A | 8/2012 |

* cited by examiner

STEEL MATERIAL SUITABLE FOR USE IN SOUR ENVIRONMENT

This is a National Phase Application filed under 35 U.S.C. § 371, of International Application No. PCT/JP2020/005642, filed Feb. 13, 2020, the contents of which are incorporated by reference.

TECHNICAL FIELD

The present disclosure relates to a steel material, and more particularly to a steel material suitable for use in a sour environment.

BACKGROUND ART

Due to the deepening of oil wells and gas wells (hereunder, oil wells and gas wells are collectively referred to as "oil wells"), there is a demand to enhance the strength of oil-well steel materials represented by oil-well steel pipes. Specifically, 80 ksi grade (yield strength is 80 to less than 95 ksi, that is, 552 to less than 655 MPa) and 95 ksi grade (yield strength is 95 to less than 110 ksi, that is, 655 to less than 758 MPa) oil-well steel pipes are being widely utilized, and recently requests are also starting to be made for 110 ksi grade (yield strength is 110 to 125 ksi, that is, 758 to 862 MPa) oil-well steel pipes.

Most deep wells are in a sour environment containing corrosive hydrogen sulfide. In the present description, a sour environment means an environment which contains hydrogen sulfide, and which is acidified. Note that a sour environment may contain carbon dioxide. Oil-well steel pipes used in such a sour environment are required to have not only high strength but also sulfide stress cracking resistance (hereinafter, referred to as "SSC resistance").

A technique of increasing SSC resistance of a steel material, such as an oil-well steel pipe, is disclosed in Japanese Patent Application Publication No. 62-253720 (Patent Literature 1), Japanese Patent Application Publication No. 59-232220 (Patent Literature 2), Japanese Patent Application Publication No. 06-322478 (Patent Literature 3), Japanese Patent Application Publication No. 08-311551 (Patent Literature 4), Japanese Patent Application Publication No. 2000-256783 (Patent Literature 5), Japanese Patent Application Publication No. 2000-29734 (Patent Literature 6), Japanese Patent Application Publication No. 2005-350754 (Patent Literature 7), National Publication of International Patent Application No. 2012-519238 (Patent Literature 8), and Japanese Patent Application Publication No. 2012-26030 (Patent Literature 9).

Patent Literature 1 proposes a method for increasing SSC resistance of steel for oil well by reducing impurities, such as Mn and P. Patent Literature 2 proposes a method for increasing SSC resistance of steel by performing quenching two times to make grain fine.

Patent Literature 3 proposes a method for increasing SSC resistance of a steel material having 125 ksi grade by making the micro-structure of steel fine by induction heat treatment. Patent Literature 4 proposes a method for increasing SSC resistance of a steel pipe having 110 to 140 ksi grade by increasing the hardenability of steel by utilizing direct quenching process and also by increasing a tempering temperature.

Patent Literature 5 and Patent Literature 6 propose a method for increasing SSC resistance of steel for low alloy oil country tubular goods having 110 to 140 ksi grade by controlling the morphology of carbide. Patent Literature 7 proposes a method for increasing SSC resistance of a steel material having 125 ksi grade or more by controlling dislocation density and a hydrogen diffusion coefficient to predetermined values. Patent Literature 8 proposes a method for increasing SSC resistance of steel having 125 ksi grade by performing quenching a plurality of times on low alloy steel which contains C of 0.3 to 0.5%. Patent Literature 9 proposes a method for controlling the morphology and the number of carbide by adopting a tempering process of two-stage heat treatment. More specifically, in Patent Literature 9, a number density of large-sized $M_3C$ or $M_2C$ is suppressed to increase SSC resistance of steel having 125 ksi grade.

CITATION LIST

Patent Literature

[Patent Literature 1] Japanese Patent Application Publication No. 62-253720

[Patent Literature 2] Japanese Patent Application Publication No. 59-232220

[Patent Literature 3] Japanese Patent Application Publication No. 06-322478

[Patent Literature 4] Japanese Patent Application Publication No. 08-311551

[Patent Literature 5] Japanese Patent Application Publication No. 2000-256783

[Patent Literature 6] Japanese Patent Application Publication No. 2000-297344

[Patent Literature 7] Japanese Patent Application Publication No. 2005-350754

[Patent Literature 8] National Publication of International Patent Application No. 2012-519238

[Patent Literature 9] Japanese Patent Application Publication No. 2012-26030

SUMMARY OF INVENTION

Technical Problem

However, a steel material (an oil-well steel pipe, for example) exhibiting yield strength of 110 ksi (758 to 862 MPa) and excellent SSC resistance may be obtained by a technique other than techniques disclosed in the aforementioned Patent Literatures 1 to 9.

It is an objective of the present disclosure to provide a steel material which has yield strength of 758 to 862 MPa (110 ksi grade), and also has excellent SSC resistance in a sour environment.

Solution to Problem

A steel material according to the present disclosure has a chemical composition consisting of, in mass %: C: 0.15 to 0.45%, Si: 0.05 to 1.00%, Mn: 0.01 to 1.00%, P: 0.030% or less, S: 0.0050% or less, Al: 0.005 to 0.100%, Cr: 0.55 to 1.10%, Mo: 0.70 to 1.00%, Ti: 0.002 to 0.020%, V: 0.05 to 0.30%, Nb: 0.002 to 0.100%, B: 0.0005 to 0.0040%, N: 0.0100% or less, O: less than 0.0020%, Ca: 0 to 0.0100%, Mg: 0 to 0.0100%, Zr: 0 to 0.0100%, rare earth metal: 0 to 0.0100%, Cu: 0 to 0.50%, Ni: 0 to 0.50%, Co: 0 to 0.50%, and W: 0 to 0.50%, with the balance being Fe and impurities, and satisfying Formula (1). In the microstructure of the steel material, a grain diameter of a prior-austenite grain is 15.0 μm or less. An average area of precipitate which is precipitated in a prior-austenite grain boundary is $12.5\times10^{-3}$ $\mu m^2$ or less in the steel material. A yield strength of the steel material is 758 to 862 MPa.

$$Mo/Cr \geq 0.90 \quad (1)$$

where, content (mass %) of a corresponding element is substituted for an element symbol in Formula (1).

Advantageous Effects of Invention

The steel material according to the present disclosure has yield strength of 758 to 862 MPa (110 ksi grade), and also has excellent SSC resistance in a sour environment.

DESCRIPTION OF EMBODIMENT

The present inventors have conducted investigations and studies regarding a method for obtaining excellent SSC resistance of a steel material which is expected to be used in a sour environment while yield strength of 758 to 862 MPa (110 ksi grade) is maintained. As a result, the following findings are obtained.

Increasing dislocation density in the steel material increases yield strength YS of the steel material. Meanwhile, there is a possibility that dislocations in the steel material occlude hydrogen. Therefore, when dislocation density in the steel material is increased, the amount of hydrogen occluded by the steel material may be increased. When hydrogen concentration in the steel material is increased as a result of an increase in dislocation density, high strength may be obtained, but SSC resistance of the steel material is reduced. Accordingly, to achieve both yield strength of 110 ksi grade and excellent SSC resistance, it is not preferable to increase strength by making use of dislocation density.

In view of the above, the present inventors considered that when yield strength of a steel material is increased using a method different from an increase in dislocation density of the steel material, excellent SSC resistance may be obtained even if yield strength of the steel material is increased to 110 ksi grade.

Specifically, the present inventors have considered that a steel material having the chemical composition including, in mass %: C: 0.15 to 0.45%, Si: 0.05 to 1.00%, Mn: 0.01 to 1.00%, P: 0.030% or less, S: 0.0050% or less, Al: 0.005 to 0.100%, Cr: 0.55 to 1.10%, Ti: 0.002 to 0.020%, V: 0.05 to 0.30%, Nb: 0.002 to 0.100%, B: 0.0005 to 0.0040%, N: 0.0100% or less, O: less than 0.0020%, Ca: 0 to 0.0100%, Mg: 0 to 0.0100%, Zr: 0 to 0.0100%, rare earth metal: 0 to 0.0100%, Cu: 0 to 0.50%, Ni: 0 to 0.50%, Co: 0 to 0.50%, and W: 0 to 0.50%, may achieve both yield strength of 110 ksi grade and SSC resistance.

The present inventors further considered that when Mo is contained in addition to the aforementioned chemical composition, alloy carbide is formed and hence, yield strength may be increased without increasing dislocation density excessively. Accordingly, the present inventors produced various steel materials where Mo is added to the aforementioned chemical composition, and investigated characteristics of the steel materials. As a result, the present inventors have newly found that, in the steel material having the aforementioned chemical composition, Mo content and the grain diameter of prior-austenite grain (hereinafter, also referred to as "priory grain") have dependencies.

Figure 1:
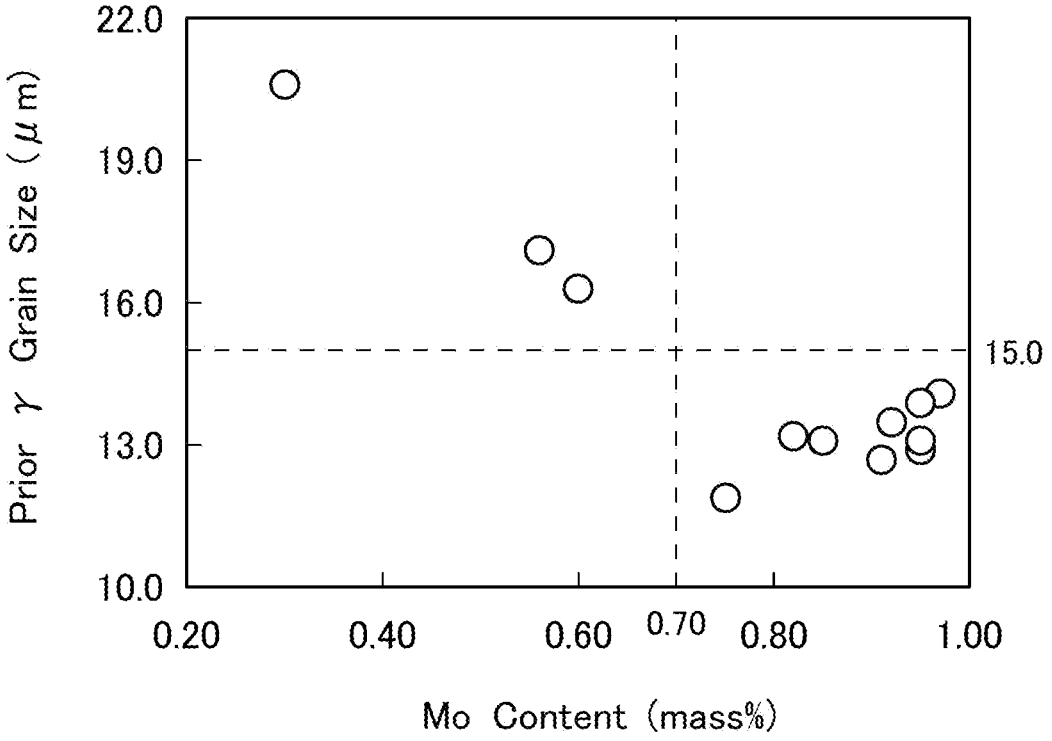
FIG. 1 is a view showing the relationship between Mo content and prior γ grain diameter.

Specifically, the relationship between Mo content and a prior γ grain diameter will be described with reference to a drawing. FIG. 1 is a view showing the relationship between Mo content and a prior γ grain diameter. FIG. 1 is formed using Mo contents (mass %) and prior γ grain diameters (μm) acquired by microstructure observation described later with respect to steel materials which have the chemical composition other than Mo content satisfying the range of the aforementioned chemical composition, and which are produced by a preferred production method described later in an example which will be described later. In the present description, "priory grain diameter" means the grain diameter of a priory grain obtained by a method conforming to a comparison method defined in ASTM E112-10.

Referring to FIG. 1, when Mo content increases, the prior γ grain diameter is dramatically reduced. It became apparent that, in the steel material having the aforementioned chemical composition, when the Mo content becomes 0.70% or more, notable advantageous effect of reducing a prior γ grain diameter to 15.0 μm or less is obtained. Further, when a prior γ grain is fine, the steel material can increase both the yield strength and the SSC resistance. Accordingly, the chemical composition of the steel material according to the present embodiment contains Mo of 0.70% or more in addition to the aforementioned chemical composition. In this case, the prior γ grain diameter in the steel material becomes 15.0 μm or less.

The present inventors consider the reason as follows. In the case where the steel material having the aforementioned chemical composition contains Mo of 0.70% or more, there is a possibility that Mo dissolved in the steel material segregates in austenite grain boundaries during heating in a quenching process. Accordingly, dissolved Mo segregated in austenite grain boundaries suppresses the movement of grain boundaries. As a result, austenite grain is prevented from being easily coarsened during heating in a quenching process and hence, it is considered that prior γ grain on which tempering is performed is made fine.

Therefore, the steel material according to the present embodiment has a chemical composition consisting of, in mass %: C: 0.15 to 0.45%, Si: 0.05 to 1.00%, Mn: 0.01 to 1.00%, P: 0.030% or less, S: 0.0050% or less, Al: 0.005 to 0.100%, Cr: 0.55 to 1.10%, Mo: 0.70 to 1.00%, Ti: 0.002 to 0.020%, V: 0.05 to 0.30%, Nb: 0.002 to 0.100%. B: 0.0005 to 0.0040%, N: 0.0100% or less, O: less than 0.0020%. Ca: 0 to 0.0100%, Mg: 0 to 0.0100%, Zr: 0 to 0.0100%, rare earth metal: 0 to 0.0100%, Cu: 0 to 0.50%. Ni: 0 to 0.50%, Co: 0 to 0.50%, W: 0 to 0.50%, and the balance being Fe and impurities. Further, in the microstructure of the steel material according to the present embodiment, a prior γ grain diameter is 15.0 μm or less.

However, in the steel material having the aforementioned chemical composition and the prior γ grain diameter of 15.0 μm or less, when an attempt is made to obtain yield strength of 110 ksi grade, there may be a case where a large amount of coarse carbide is precipitated in the steel material. As a result of further investigation performed by the present inventors, it has been found that, when a large amount of coarse carbide is precipitated in the steel material having the aforementioned chemical composition, the steel material may not obtain excellent SSC resistance in a sour environment.

Accordingly, the present inventors have discussed in more detail with respect to carbide which reduces SSC resistance in the steel material having the aforementioned chemical composition. As a result, the following findings have been acquired. Coarse carbide is liable to form stress concentrators, and promotes propagation of cracks caused by SSC. Therefore, it has been considered that reducing coarse carbide increases SSC resistance of a steel material.

However, as the result of detailed discussion performed by the present inventors, the present inventors have found that, of the coarse carbide, particularly, coarse carbide which is precipitated in prior γ grain boundaries may cause a reduction in SSC resistance of a steel material. That is, the present inventors have found that SSC resistance of a steel material can be increased not by simply reducing coarse carbide but by reducing coarse carbide which is precipitated in the prior γ grain boundaries.

In the steel material according to the present embodiment having the aforementioned chemical composition, most of the precipitates which are precipitated in the prior γ grain boundary are carbide. Accordingly, reducing coarse precipitates which are precipitated in the prior γ grain boundaries can reduce coarse carbide which is precipitated in the prior γ grain boundaries. In the present description, precipitates which are precipitated in the prior γ grain boundaries are also referred to as "specific precipitates".

The present inventors have discussed in more detail with the relation between the steel material which has the aforementioned chemical composition and the prior γ grain diameter of 15.0 μm or less, and the specific precipitates. Specifically, the present inventors then produced various kinds of steel materials which have the aforementioned chemical composition and the prior γ grain diameter is 15.0 μm or less, and investigated the average area of the specific precipitates.

As a result, the present inventors found that, in the steel material having the aforementioned chemical composition and the prior γ grain diameter is 15.0 μm or less, the ratio of the Mo content to the Cr content (Mo/Cr) affects the average area of the specific precipitates.

Figure 2:
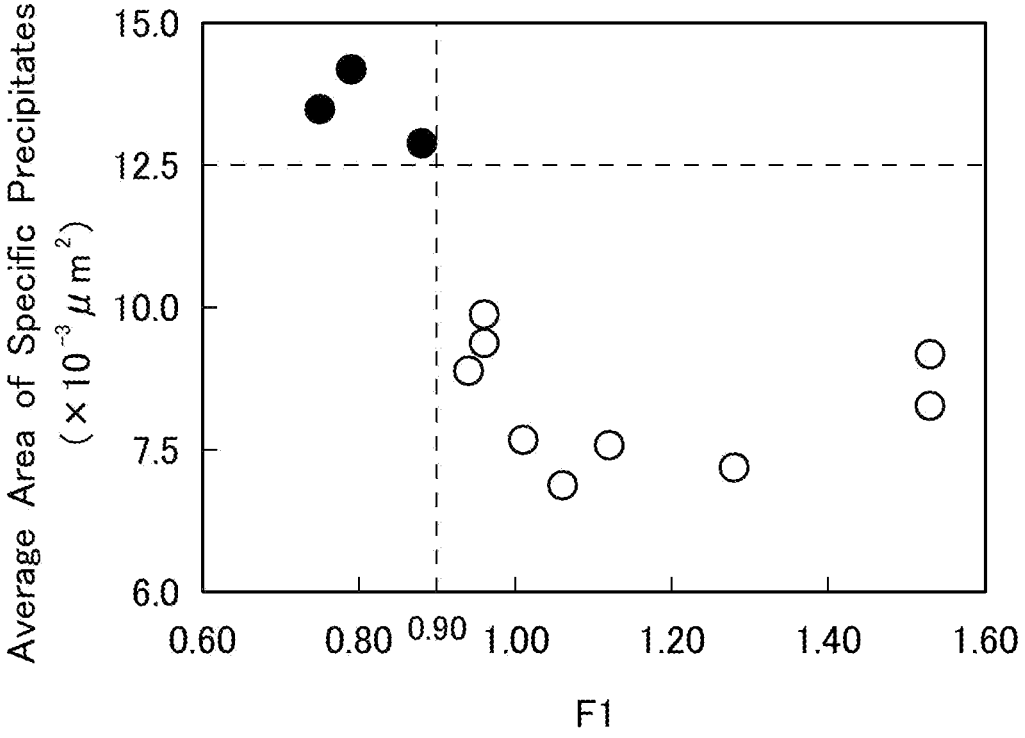
FIG. 2 is a view showing the relationship between F1(=Mo/Cr) and average area of specific precipitates.

F1 is defined as Mo/Cr. FIG. 2 is a view showing the relationship between F1 and average area of specific precipitates. FIG. 2 is formed using F1 and average area of the specific precipitates ($\times 10^{-3}$ $\mu m^2$) acquired by microstructure observation described later with respect to steel materials which have the aforementioned chemical composition and SSC resistance evaluated by a method in accordance with "Method A" specified in NACE TM0177-2005, and which are produced by a preferred production method described later in an example which will be described later. Note that, the symbol "○" in FIG. 2 indicates a steel material for which the result of the SSC resistance test was good. On the other hand, the symbol "●" in FIG. 2 indicates a steel material for which the result of the SSC resistance test was not good.

Referring to FIG. 2, when F1 increases, the average area of specific precipitates is dramatically reduced. Specifically, in the steel material having the aforementioned chemical composition and the prior γ grain diameter is 15.0 μm or less, when F1 is 0.90 or more, the average area of specific precipitates is $12.5\times10^{-3}$ $\mu m^2$ or less. In this case, the steel material shows excellent SSC resistance. On the other hand, when F1 is less than 0.90, the average area of specific precipitates is more than $12.5\times10^{-3}$ $\mu m^2$, the steel material does not show excellent SSC resistance.

The detailed reason has not been clarified. However, in the steel material having the aforementioned chemical composition and the prior γ grain diameter is 15.0 μm or less, when F1 is 0.90 or more, the average area of specific precipitates is $12.5\times10^{-3}$ $\mu m^2$ or less, and therefore, the SSC resistance of the steel material can be increased. The effect is proved by the present example described later.

Accordingly, the steel material according to the present embodiment has the aforementioned chemical composition, F1 is 0.90 or more, a prior γ grain diameter is 15.0 μm or less and, further, the average area of the specific precipitates is 12.5×10'3 $\mu m^2$ or less. As a result, the steel material according to the present embodiment can achieve both yield strength of 758 to 862 MPa (110 ksi grade) and excellent SSC resistance in a sour environment.

The steel material according to the present embodiment completed based on the aforementioned findings has the chemical composition consisting of, by mass %, C: 0.15 to 0.45%, Si: 0.05 to 1.00%, Mn: 0.01 to 1.00%, P: 0.030% or less, S: 0.0050% or less, Al: 0.005 to 0.100%, Cr: 0.55 to 1.10%, Mo: 0.70 to 1.00%, Ti: 0.002 to 0.020%, V: 0.05 to 0.30%. Nb: 0.002 to 0.100%, B: 0.0005 to 0.0040%, N: 0.0100% or less, O: less than 0.0020%, Ca: 0 to 0.0100%, Mg: 0 to 0.0100%, Zr: 0 to 0.0100%, rare earth metal: 0 to 0.0100%, Cu: 0 to 0.50%, Ni: 0 to 0.50%, Co: 0 to 0.50%, and W: 0 to 0.50%, with the balance being Fe and impurities, and satisfying Formula (1). In the microstructure of the steel material, the grain diameter of a prior-austenite grain is 15.0 μm or less. In the steel material, the average area of precipitates which are precipitated in the prior-austenite grain boundary is $12.5\times10^{-1}$ $\mu m^2$ or less. A yield strength of the steel material is 758 to 862 MPa.

$$Mo/Cr \geq 0.90 \quad (1)$$

where, content (mass %) of a corresponding element is substituted for each symbol of an element in Formula (1).

In the present description, the steel material is not particularly limited. However, the steel material may be a steel pipe or a steel plate, for example.

The steel material according to the present embodiment exhibits yield strength of 758 to 862 MPa (110 ksi grade) and excellent SSC resistance.

The aforementioned chemical composition may contain one or more types of element selected from the group consisting of Ca: 0.0001 to 0.0100%, Mg: 0.0001 to 0.0100%, Zr: 0.0001 to 0.0100%, and rare earth metal: 0.0001 to 0.0100%.

The aforementioned chemical composition may contain one or more types of element selected from the group consisting of Cu: 0.02 to 0.50%, and Ni: 0.02 to 0.50%.

The aforementioned chemical composition may contain one or more types of element selected from the group consisting of Co: 0.02 to 0.50%, and W: 0.02 to 0.50%.

The aforementioned steel material may be an oil-well steel pipe.

In the present description, the oil-well steel pipe may be a steel pipe that is used for a line pipe or may be a steel pipe used for oil country tubular goods (OCTG). The shape of the oil-well steel pipe is not limited, and for example, the oil-well steel pipe may be a seamless steel pipe or may be a welded steel pipe. The oil country tubular goods are, for example, steel pipes that are used for use in casing or tubing.

The aforementioned steel material may be a seamless steel pipe. When the steel material according to the present embodiment is a seamless steel pipe, even if a wall thickness is 15 mm or more, the steel material has yield strength of 758 to 862 MPa (110 ksi grade), and also has more stable SSC resistance in a sour environment.

The aforementioned excellent SSC resistance can be evaluated specifically by a method in accordance with "Method A" specified in NACE TM0177-2005 and a four-point bending test. In the method in accordance with "Method A" specified in NACE TM0177-2005, a mixed aqueous solution containing 5.0 mass % of sodium chloride and 0.5 mass % of acetic acid (NACE solution A) at 24° C. is employed as a test bath. A stress equivalent to 90% of the actual yield stress is applied to the test specimen that is taken from the steel material according to the present embodiment, and the test specimen is immersed into the test bath. The test bath is degassed, thereafter, $H_2S$ gas at 1 atm is blown into the test bath to cause saturation of the $H_2S$ gas. The test bath where saturation of the $H_2S$ gas is caused is held for 720 hours at 24° C.

Meanwhile, in the four-point bending test, stress is applied to a test specimen taken from the steel material by four-point bending in accordance with ASTM G39-99 (2011) such that stress applied to the test specimen is set to 90% of actual yield stress of the steel material. 5.0 mass % sodium chloride aqueous solution at 24° C. is employed as a test bath. The test specimen to which stress is applied is immersed into the test bath in the autoclave. The test bath is degassed, thereafter, $H_2S$ gas at 15 atm is pressure-sealed into the autoclave. After the autoclave is sealed, the test bath is stirred for 720 hours at 24° C.

In the steel material according to the present embodiment, cracking is not confirmed after 720 hours elapses in both the aforementioned method in accordance with "Method A" and the four-point bending test.

Hereinafter, a steel material according to the present embodiment will be described in detail. Unless otherwise specified, "%" in relation to an element means mass %.

[Chemical Composition]

The chemical composition of the steel material according to the present embodiment contains the following elements.

C: 0.15 to 0.45%

Carbon (C) increases the hardenability of the steel material, thus increasing the yield strength of the steel material. Further, C promotes spheroidization of carbides during tempering in a production process, thus the SSC resistance of the steel material is increased. When the carbides are dispersed, the yield strength of the steel material is further increased. When the C content is too low, these advantageous effects cannot be obtained. On the other hand, when the C content is too high, toughness of a steel material is reduced so that quenching cracks are liable to occur. Accordingly, the C content is within the range of 0.15 to 0.45%. A preferable lower limit of the C content is 0.18%, more preferably is 0.20%, further preferably is 0.22%, and further preferably is 0.25%. A preferable upper limit of the C content is 0.40%, more preferably is 0.38%, and further preferably is 0.35%.

Si: 0.05 to 1.00%

Silicon (Si) deoxidizes the steel. When the Si content is too low, this advantageous effect cannot be obtained. On the other hand, when the Si content is too high, the SSC resistance of a steel material is reduced. Accordingly, the Si content is within a range of 0.05 to 1.00%. A preferable lower limit of the Si content is 0.10%, and more preferably is 0.15%. A preferable upper limit of the Si content is 0.85%, more preferably is 0.70%, and further preferably is 0.60%.

Mn: 0.01 to 1.00%

Manganese (Mn) deoxidizes the steel. Mn also enhances the hardenability of a steel material, thus the yield strength of the steel material is increased. When the Mn content is too low, these advantageous effects cannot be obtained. On the other hand, when the Mn content is too high, Mn segregates in grain boundaries together with impurities, such as P and S. In this case, the SSC resistance of the steel material is reduced. Accordingly, the Mn content is within a range of 0.01 to 1.00%. A preferable lower limit of the Mn content is 0.02%, more preferably is 0.03%, and further preferably is 0.10%. A preferable upper limit of the Mn content is 0.80%, more preferably is 0.70%, further preferably is 0.65%, further preferably is less than 0.60%, and further preferably is 0.55%.

P: 0.030% or Less

Phosphorus (P) is an impurity. That is, the P content is more than 0%. P segregates at the grain boundaries, and reduces the SSC resistance of a steel material. Accordingly, the P content is 0.030% or less. A preferable upper limit of the P content is 0.025%, and more preferably is 0.020%. Preferably, the P content is as low as possible. However, when the P content is excessively reduced, the production cost increases significantly. Accordingly, in consideration of industrial production, a preferable lower limit of the P content is 0.0001%, more preferably is 0.0003%, further preferably is 0.001%, and further preferably is 0.002%.

S: 0.0050% or Less

Sulfur (S) is an impurity. That is, the S content is more than 0%. S segregates at the grain boundaries, and reduces the SSC resistance of a steel material. Accordingly, the S content is 0.0050% or less. A preferable upper limit of the S content is 0.0040%, more preferably is 0.0030%, and further preferably is 0.0020%. Preferably, the S content is as low as possible. However, when the S content is excessively reduced, the production cost increases significantly. Accordingly, in consideration of industrial production, a preferable lower limit of the P content is 0.0001%, and more preferably is 0.0003%.

Al: 0.005 to 0.100%

Aluminum (Al) deoxidizes the steel. When the Al content is too low, this advantageous effect cannot be obtained, and the SSC resistance of a steel material is reduced. On the other hand, when the Al content is too high, coarse oxide-based inclusions are formed, and the SSC resistance of the steel material is reduced. Accordingly, the Al content is within a range of 0.005 to 0.100%. A preferable lower limit of the Al content is 0.015%, and more preferably is 0.020%. A preferable upper limit of the Al content is 0.080%, and more preferably is 0.060%. In the present description, the "Al" content means content of "acid-soluble Al", that is, the content of "sol. Al".

Cr: 0.55 to 1.10%

Chromium (Cr) increases the hardenability of the steel material, and increasing the yield strength of the steel material. Further, Cr increases temper softening resistance, and enabling high temperature tempering. As a result, the SSC resistance of the steel material is increased. When the Cr content is too low, these advantageous effects cannot be obtained. On the other hand, when the Cr content is too high, coarse carbides are formed in prior 7 grain boundaries in the steel material. In this case, the SSC resistance of the steel material is reduced. Accordingly, the Cr content is within a range of 0.55 to 1.10%. A preferable lower limit of the Cr content is 0.57%, more preferably is 0.60%, further preferably is 0.65%, further preferably is 0.67%, and further preferably is 0.70%. A preferable upper limit of the Cr content is 1.05%, more preferably is 1.00%, further preferably is less than 1.00%, further preferably is 0.95%, and further preferably is 0.90%.

Mo: 0.70 to 1.00%

Molybdenum (Mo) increases the hardenability of the steel material, and increasing the yield strength of the steel material. Further, Mo is dissolved in the steel material, and a part of the dissolved Mo segregates in austenite grain boundaries during heating in a quenching process. As a result, the prior γ grain diameter in the steel material on which tempering is performed is reduced by a pinning effect. In this case, the SSC resistance of the steel material is increased. When the Mo content is too low, these advantageous effects cannot be obtained. On the other hand, when the Mo content is too high, coarse carbides are formed in prior γ grain boundaries in the steel material. In this case, the SSC resistance of the steel material is reduced. Accordingly, the Mo content is within a range of 0.70 to 1.00%. A preferable lower limit of the Mo content is 0.72%, more preferably is 0.75%, further preferably is 0.78%, further preferably is 0.80%, and further preferably is 0.82%. A preferable upper limit of the Mo content is less than 1.00%, more preferably is 0.97%, further preferably is 0.95%, further preferably is 0.90%, and further preferably is 0.87%.

Ti: 0.002 to 0.020%

Titanium (Ti) forms nitride, and refines the microstructure of the steel material by the pinning effect. As a result, the SSC resistance of the steel material is increased. When the Ti content is too low, this advantageous effect cannot be obtained. On the other hand, when the Ti content is too high, a large amount of Ti nitride is formed. As a result, the SSC resistance of the steel material is reduced. Accordingly, the Ti content is within a range of 0.002 to 0.020%. A preferable lower limit of the Ti content is 0.003%, and more preferably is 0.004%. A preferable upper limit of the Ti content is 0.018%, and more preferably is 0.015%.

V: 0.05 to 0.30%

Vanadium (V) combines with C and/or N to form carbides, nitrides, or carbo-nitrides (hereinafter, referred to as "carbo-nitrides and the like"). Carbo-nitrides and the like refines the microstructure of the steel material by the pinning effect. As a result, the SSC resistance of the steel material is increased. V also combines with C to form fine carbides. As a result, the yield strength of the steel material is increased. When the V content is too low, these advantageous effects cannot be obtained. On the other hand, when the V content is too high, carbo-nitrides and the like is excessively formed, and the SSC resistance of the steel material is reduced. Accordingly, the V content is within a range of 0.05 to 0.30%. A preferable lower limit of the V content is more than 0.05%, more preferably is 0.06%, further preferably is 0.07%, and further preferably is 0.09%. A preferable upper limit of the V content is 0.25%, more preferably is 0.20%, and further preferably is 0.15%.

Nb: 0.002 to 0.100%

Niobium (Nb) combines with C and/or N to form carbo-nitrides and the like. Carbo-nitrides and the like refines the microstructure of the steel material by the pinning effect. As a result, the SSC resistance of the steel material is increased. Nb also combines with C to form fine carbides. As a result, the yield strength of the steel material is increased. When the Nb content is too low, these advantageous effects cannot be obtained. On the other hand, when the Nb content is too high, carbo-nitrides and the like is excessively formed, and the SSC resistance of the steel material is reduced. Accordingly, the Nb content is within a range of 0.002 to 0.100%. A preferable lower limit of the Nb content is 0.005%, more preferably is 0.010%, further preferably is 0.012%, and further preferably is 0.015%. A preferable upper limit of the Nb content is 0.080%, more preferably is 0.060%, further preferably is 0.050%, and further preferably is 0.030%.

B: 0.0005 to 0.0040%

Boron (B) dissolves in the steel, increasing the hardenability of the steel material and increases the yield strength of the steel material. When the B content is too low, this advantageous effect cannot be obtained. On the other hand, when the B content is too high, coarse nitrides are formed, and the SSC resistance of the steel material is reduced. Accordingly, the B content is within a range of 0.0005 to 0.0040%. A preferable lower limit of the B content is 0.0007%, more preferably is 0.0010%, and further preferably is 0.0012%. A preferable upper limit of the B content is 0.0035%, more preferably is 0.0030%, and further preferably is 0.0025%.

N: 0.0100% or Less

Nitrogen (N) is unavoidably contained. That is, the N content is more than 0%. N combines with Ti to form fine nitrides and thereby refines the microstructure of the steel material by a pinning effect. As a result, the SSC resistance of the steel material is increased. On the other hand, when the N content is too high, coarse nitrides are formed, and the SSC resistance of the steel material is reduced. Accordingly, the N content is 0.0100% or less. A preferable upper limit of the N content is 0.0080%, and more preferably is 0.0070%. A preferable lower limit of the N content for effectively obtaining the aforementioned advantageous effects is 0.0020%, more preferably 0.0025%, further preferably is 0.0030%, further preferably is 0.0035%, and further preferably is 0.0040%.

O: Less than 0.0020%

Oxygen (O) is an impurity. That is, the O content is more than 0%. O forms coarse oxides and reduces the SSC resistance of the steel material. Accordingly, the O content is less than 0.0020%. A preferable upper limit of the O content is 0.0018%, and more preferably is 0.0015%. Preferably, the O content is as low as possible. However, when the O content is excessively reduced, the production cost increases significantly. Accordingly, in consideration of industrial production, a preferable lower limit of the O content is 0.0001%, and more preferably is 0.0003%.

The balance of the chemical composition of the steel material according to the present embodiment is Fe and impurities. In the present embodiment, "impurities" mean materials which are mixed into the steel material from ore or scrap as a raw material, a production environment or the like in industrially producing the steel material, and which are allowed within a range where the impurities do not adversely affect the steel material of the present embodiment.

[Optional Element]

The chemical composition of the aforementioned steel material may further contain one or more types of element selected from the group consisting of Ca, Mg, Zr, and rare earth metal (REM) in lieu of a part of Fe. Each of these elements is an optional element, that controls the morphology of sulfides in the steel material and increases the SSC resistance of the steel material.

Ca: 0 to 0.0100%

Calcium (Ca) is an optional element, and may not be contained. That is, the Ca content may be 0%. When Ca is contained, Ca renders S in the steel material harmless by forming sulfides, and thereby increases the SSC resistance of the steel material. If even a small amount of Ca is contained, it is possible to obtain this advantageous effect to some extent. However, when the Ca content is too high, oxides in the steel material coarsen and the SSC resistance of the steel material is reduced. Accordingly, the Ca content is within a range of 0 to 0.0100%. A preferable lower limit of the Ca content is more than 0%, more preferably is 0.0001%, further preferably is 0.0003%, further preferably is 0.0006%, and further preferably is 0.0010%. A preferable upper limit of the Ca content is 0.0040%, more preferably is 0.0030%, further preferably is 0.0025%, and further preferably is 0.0020%.

Mg: 0 to 0.0100%

Magnesium (Mg) is an optional element, and may not be contained. That is, the Mg content may be 0%. When Mg is contained, Mg renders S in the steel material harmless by forming sulfides, and thereby increases the SSC resistance of the steel material. If even a small amount of Mg is contained, it is possible to obtain this advantageous effect to some extent. However, when the Mg content is too high, oxides in the steel material coarsen and the SSC resistance of the steel material is reduced. Accordingly, the Mg content is within a range of 0 to 0.0100%. A preferable lower limit of the Mg content is more than 0%, more preferably is 0.0001%, further preferably is 0.0003%, further preferably is 0.0006%, and further preferably is 0.0010%. A preferable upper limit of the Mg content is 0.0040%, more preferably is 0.0030%, further preferably is 0.0025%, and further preferably is 0.0020%.

Zr: 0 to 0.0100%

Zirconium (Zr) is an optional element, and may not be contained. That is, the Zr content may be 0%. When Zr is contained, Zr renders S in the steel material harmless by forming sulfides, and thereby increases the SSC resistance of the steel material. If even a small amount of Zr is contained, it is possible to obtain this advantageous effect to some extent. However, when the Zr content is too high, oxides in the steel material coarsen and the SSC resistance of the steel material is reduced. Accordingly, the Zr content is within a range of 0 to 0.0100%. A preferable lower limit of the Zr content is more than 0%, more preferably is 0.0001%, further preferably is 0.0003%, further preferably is 0.0006%, and further preferably is 0.0010%. A preferable upper limit of the Zr content is 0.0040%, more preferably is 0.0030%, further preferably is 0.0025%, and further preferably is 0.0020%.

Rare Earth Metal (REM): 0 to 0.0100%

Rare earth metal (REM) is an optional element, and may not be contained. That is, the REM content may be 0%. When REM is contained, REM renders S in the steel material harmless by forming sulfides, and thereby increases the SSC resistance of the steel material. REM also combines with P in the steel material and suppresses segregation of P at the grain boundaries. Therefore, a reduction in the low temperature toughness and the SSC resistance of the steel material that is attributable to segregation of P is suppressed. If even a small amount of REM is contained, it is possible to obtain these advantageous effects to some extent. However, when the REM content is too high, oxides in the steel material coarsen, and the low temperature toughness and the SSC resistance of the steel material are reduced. Accordingly, the REM content is within a range of 0 to 0.0100%. A preferable lower limit of the REM content is more than 0%, more preferably is 0.0001%, further preferably is 0.0003%, further preferably is 0.0006%, and further preferably is 0.0010%. A preferable upper limit of the REM content is 0.0040%, more preferably is 0.0030%, further preferably is 0.0025%, and further preferably is 0.0020%.

Note that, in the present description the term "REM" refers to one or more types of element selected from a group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

The chemical composition of the aforementioned steel material may further contain one or more types of element selected from the group consisting of Cu and Ni in lieu of a part of Fe. Each of these elements is an optional element, and increases the hardenability of the steel material.

Cu: 0 to 0.50%

Copper (Cu) is an optional element, and may not be contained. That is, the Cu content may be 0%. When Cu is contained, Cu increases the hardenability of the steel material, and thereby increasing the yield strength of the steel material. If even a small amount of Cu is contained, it is possible to obtain this advantageous effect to some extent. However, when the Cu content is too high, the hardenability of the steel material becomes too high, and the SSC resistance of the steel material is reduced. Accordingly, the Cu content is within a range of 0 to 0.50%. A preferable lower limit of the Cu content is more than 0%, more preferably is 0.02%, further preferably is 0.03%, and further preferably is 0.05%. A preferable upper limit of the Cu content is 0.35%, and more preferably is 0.25%.

Ni: 0 to 0.50%

Nickel (Ni) is an optional element, and may not be contained. That is, the Ni content may be 0%. When Ni is contained, Ni increases the hardenability of the steel material, and thereby increasing the yield strength of the steel material. If even a small amount of Ni is contained, it is possible to obtain this advantageous effect to some extent. However, when the Ni content is too high, corrosion is locally promoted, and thereby the SSC resistance of the steel material is reduced. Accordingly, the Ni content is within a range of 0 to 0.50%. A preferable lower limit of the Ni content is more than 0%, more preferably is 0.02%, further preferably is 0.03%, and further preferably is 0.05%. A preferable upper limit of the Ni content is 0.35%, and more preferably is 0.25%.

The chemical composition of the aforementioned steel material may further contain one or more types of element selected from the group consisting of Co and W in lieu of a part of Fe. Each of these elements is an optional element, that forms corrosion coating having protectability in a hydrogen sulfide environment, and thereby suppressing hydrogen penetration. With such a configuration, these elements increase the SSC resistance of the steel material.

Co: 0 to 0.50%

Cobalt (Co) is an optional element, and may not be contained. That is, the Co content may be 0%. When Co is contained, Co forms corrosion coating having protectability in a hydrogen sulfide environment, and thereby suppressing hydrogen penetration. As a result, the SSC resistance of the steel material is increased. If even a small amount of Co is contained, it is possible to obtain this advantageous effect to some extent. However, when the Co content is too high, the hardenability of the steel material is reduced so that the yield strength of the steel material is reduced. Accordingly, the Co content is within a range of 0 to 0.50%. A preferable lower limit of the Co content is more than 0%, more preferably is 0.02%, further preferably is 0.03%, and further preferably is 0.05%. A preferable upper limit of the Co content is 0.45%, and more preferably is 0.40%.

W: 0 to 0.50%

Tungsten (W) is an optional element, and may not be contained. That is, the W content may be 0%. When W is contained, W forms corrosion coating having protectability in a hydrogen sulfide environment, and thereby suppressing hydrogen penetration. As a result, the SSC resistance of the steel material is increased. If even a small amount of W is contained, it is possible to obtain this advantageous effect to some extent. However, when the W content is too high, coarse carbides are formed in the steel material, and the SSC resistance of the steel material is reduced. Accordingly, the W content is within a range of 0 to 0.50%. A preferable lower limit of the W content is more than 0%, more preferably is 0.02%, further preferably is 0.03%, and further preferably is 0.05%. A preferable upper limit of the W content is 0.45%, and more preferably is 0.40%.

[Formula (1)]

The chemical composition of the steel material according to the present embodiment also satisfies Formula (1).

$$Mo/Cr \geq 0.90 \quad (1)$$

where, content (mass %) of a corresponding element is substituted for each symbol of an element in Formula (1).

F1 (=Mo/Cr) is an index showing the average area of specific precipitates in the steel material having the aforementioned chemical composition. Referring to FIG. 2, when F1 is 0.90 or more, notable advantageous effect of reducing the average area of specific precipitates to $12.5\times10^{-3}$ $\mu m^2$ or less is obtained. Referring to FIG. 2, when the average area of specific precipitates is $12.5\times10^{-3}$ $\mu m^2$ or less, the steel material has the excellent SSC resistance.

On the other hand, when F1 is less than 0.90, the average area of specific precipitates is too large. As a result, the steel material does not have the excellent SSC resistance. Therefore, the steel material according to the present embodiment satisfies the aforementioned chemical composition, and further, F1 of 0.90 or more.

A preferable lower limit of F1 is 0.92, more preferably is 0.96, and further preferably is 1.00. A preferable upper limit of F1 is not particularly limited. However, in the steel material according to the present embodiment having the aforementioned chemical composition, the upper limit of F1 may be 1.67, for example. A preferable upper limit of F1 is 1.60, more preferably is 1.55, further preferably is 1.50, further preferably is 1.45, and further preferably is 1.40.

[Prior-Austenite Grain Diameter]

In the microstructure of the steel material according to the present embodiment, the prior-austenite grain diameter (prior γ grain diameter) is 15.0 μm or less. As described above, in the present description, the grain diameter of prior-austenite grain (prior γ grain diameter) means the grain diameter of prior-austenite grain obtained in accordance with a comparison method of ASTM E112-10. When prior γ grain of a steel material is fine, yield strength and SSC resistance are stably increased. In view of the above, in the present embodiment, the steel material contains Mo of 0.70% or more to make prior γ grain of the steel material fine.

When the prior γ grain diameter in the steel material according to the present embodiment is 15.0 μm or less, both yield strength of 110 ksi grade and excellent SSC resistance can be achieved provided that the other specifications of the steel material according to the present embodiment are satisfied.

A preferable upper limit of the prior γ grain diameter in the steel material according to the present embodiment is less than 15.0 μm, more preferably is 14.5 μm, further preferably is 14.0 μm, and further preferably is 13.5 μm. A preferable lower limit of the prior γ grain diameter in the steel material according to the present embodiment is not particularly limited. However, the lower limit of the prior γ grain diameter in the steel material according to the present embodiment may be 4.5 μm, for example.

As described above, the prior γ grain diameter can be obtained in accordance with a comparison method of ASTM E112-10. More specifically, the priory grain diameter can be acquired by the following method. In the case where the steel material is a steel plate, a test specimen having an observation surface perpendicular to the rolling direction is cut out from the center portion of the thickness. In the case where the steel material is a steel pipe, a test specimen having an observation surface perpendicular to the axial direction of the steel pipe is cut out from the center portion of the wall thickness. The observation surface is polished into a mirror surface and, thereafter, is embedded into a resin. Then, the test specimen is immersed into a 2% nital etching reagent for approximately 10 seconds to develop prior γ grain boundaries by etching.

The etched observation surface is subjected to 10 field observation in a secondary electron image using a Scanning Electron Microscope (SEM) to form a photographic image. The observation magnification is ×200, for example. By comparing the formed photographic image with a grain size number standard view which is defined in ASTM E112-10, the grain size number is evaluated. The average grain diameter of prior γ grain in each visual field is acquired from the evaluated grain size number. The arithmetic average value of the average grain diameters of prior γ grains acquired in 10 visual field is defined as the grain diameter of the prior γ grain (prior γ grain diameter) (μm).

[Precipitates which are Precipitated in Prior γ Grain Boundaries]

In the steel material according to the present embodiment, the average area of precipitates which are precipitated in the prior-austenite grain boundaries (priory grain boundaries) is $12.5\times10^{-3}$ $\mu m^2$ or less. As described above, in the present description, precipitates which are precipitated in the prior γ grain boundaries are also referred to as "specific precipitates". When the average area of specific precipitates is $12.5\times10^{-3}$ $\mu m^2$ or less, both yield strength of 110 ksi grade and excellent SSC resistance can be achieved provided that the other specifications of the steel material according to the present embodiment are satisfied.

As described above, in the steel material having the aforementioned chemical composition and the prior γ grain diameter of 15.0 μm or less, when an attempt is made to obtain yield strength of 110 ksi grade, there may be a case where a large amount of coarse carbide is precipitated in the steel material. Further, of the coarse carbide in the steel material, carbide which is precipitated in the prior γ grain boundaries reduces SSC resistance of the steel material. In the steel material according to the present embodiment, most of the precipitates which are precipitated in the prior γ grain boundaries are carbide.

In view of the above, in the steel material according to the present embodiment, the average area of precipitates (specific precipitates) which are precipitated in the prior γ grain boundaries is set to $12.5\times10^{-3}$ $\mu m^2$ or less. When the average area of the specific precipitates is more than $12.5\times10^{-3}$ $\mu m^2$, there may be a case where SSC resistance of a steel material be reduced. When the average area of the specific precipitates is more than $12.5\times10^{-3}$ $\mu m^2$, there may be also a case where yield strength of 758 to 862 MPa (110 ksi grade) cannot be obtained.

Accordingly, in the steel material according to the present embodiment, the average area of the specific precipitates is $12.5\times10^{-3}$ $\mu m^2$ or less. A preferable upper limit of the average area of the specific precipitates is $12.0\times10^{-3}$ $\mu m^2$, more preferably is $11.5\times10^{-3}$ $\mu m^2$, further preferably is $11.0\times10^{-3}$ $\mu m^2$, and further preferably is $10.0\times10^{-3}$ $\mu m^2$.

The lower limit of the average area of the specific precipitates is not particularly limited, and may be $0.0\times10^{-3}$ $\mu m^2$. However, in the steel material according to the present embodiment having the aforementioned chemical composition, the lower limit of the average area of the specific precipitates may be $3.0\times10^{-3}$ $\mu m^2$, for example.

The average area of the specific precipitates can be acquired by the following method. A test specimen is cut out from the steel material in a similar manner of the aforementioned determined method of the prior γ grain diameter. Specifically, in the case where the steel material is a steel plate, a test specimen having an observation surface perpendicular to the rolling direction is cut out from the center portion of the thickness. In the case where the steel material is a steel pipe, a test specimen having an observation surface perpendicular to the axial direction of the steel pipe is cut out from the center portion of the wall thickness. The observation surface is polished into a mirror surface and, thereafter, is embedded into a resin. Then, the test specimen is immersed into a 2% nital etching reagent for approximately 10 seconds to develop priory grain boundaries by etching. The etched observation surface is subjected to 10 field observation in a secondary electron image using a SEM to form a photographic image. The observation magnification is ×10000 (ten thousand), for example.

The prior γ grain boundaries are specified from the formed photographic image based on the contrast. The precipitates are also specified from the formed photographic image based on the contrast. Note that, as described above, the observation magnification is ×10000, for example. In addition, precipitates can be identified based on contrast when the precipitates have the equivalent circular diameter is 50 nm or more. On the other hands, in the present embodiment, the upper limit of equivalent circular diameter of the identified precipitates is not particularly limited. In the steel material having the aforementioned chemical composition, the upper limit of the equivalent circular diameter of the identified precipitates is 1000 nm, for example. Therefore, in the present embodiment, the equivalent circular diameter of the identified precipitates is within a range of 50 to 1000 nm, for example.

Precipitates which overlap with the specified prior γ grain boundaries and/or which come into contact with the specified prior γ grain boundaries are specified as "specific precipitates". That is, the specific precipitates (precipitates which are precipitated in the prior γ grain boundaries) mean precipitates which partially overlap and/or come into contact with the prior γ grain boundary. The average area ($\mu m^2$) of the specified specific precipitates is acquired by performing an image analysis.

[Microstructure]

The microstructure of the steel material according to the present embodiment is principally composed of tempered martensite and tempered bainite. More specifically, in the microstructure, the sum of the volume ratio of tempered martensite and the volume ratio of tempered bainite is 90% or more. The balance of microstructure consists of ferrite or pearlite, for example.

When the microstructure of the steel material having the aforementioned chemical composition contains tempered martensite and tempered bainite such that the sum of the volume ratio of tempered martensite and the volume ratio of tempered bainite is 90% or more, the steel material has yield strength of 758 to 862 MPa (110 ksi grade) provided that the other specifications of the present embodiment are satisfied.

The sum of the volume ratio of tempered martensite and the volume ratio of tempered bainite can be acquired by performing the microstructure observation. In performing the microstructure observation, the aforementioned photographic image formed at the time of acquiring the prior γ grain diameter is used. In each visual field, tempered martensite and tempered bainite can be distinguished from other phases (ferrite or pearlite, for example) based on the contrast. Accordingly, in each visual field, tempered martensite and tempered bainite are specified based on the contrast.

The sum of the area fraction of the specified tempered martensite and the area fraction of the specified tempered bainite is acquired. In the present embodiment, the arithmetic average value of the sums of the area fraction of tempered martensite and the area fraction of tempered bainite, which are acquired in all visual fields, is assumed as the volume ratio of tempered martensite and tempered bainite.

[Yield Strength of Steel Material]

Yield strength of the steel material according to the present embodiment is 758 to 862 MPa (110 ksi grade). Yield strength in the present description means stress at 0.7% elongation (0.7% yield stress) acquired in a tensile test. Even if yield strength of the steel material according to the present embodiment is 110 ksi grade, the steel material according to the present embodiment has excellent SSC resistance provided that the aforementioned chemical composition, prior γ grain diameter, and average area of the specific precipitates are satisfied.

Yield strength of the steel material according to the present embodiment can be acquired by the following method. The tensile test is performed by a method conforming to ASTM E8/E8M (2013). A round bar test specimen is taken from the steel material according to the present embodiment. In the case where the steel material is a steel plate, a round bar test specimen is taken from a center portion of the thickness. In the case where a steel material is a steel pipe, a round bar test specimen is taken from a center portion of the wall thickness. The size of the round bar test specimen is such that the diameter of a parallel portion is 8.9 mm and the length of the parallel portion is 35.6 mm, for example. The axial direction of the round bar test specimen is parallel to the rolling direction of the steel material. The tensile test is performed using the round bar test specimen in the atmosphere at the normal temperature (25° C.), and the acquired stress at 0.7% elongation is defined as yield strength (MPa).

[SSC Resistance of Steel Material]

SSC resistance of the steel material according to the present embodiment can be evaluated by a method in accordance with "Method A" specified in NACE TM0177-2005, and a four-point bending test.

In the method in accordance with "Method A" specified in NACE TM0177-2005, a round bar test specimen is taken from the steel material according to the present embodiment. In the case where the steel material is a steel plate, a round bar test specimen is taken from a center portion of the thickness. In the case where the steel material is a steel pipe, a round bar test specimen is taken from the center portion of the wall thickness. The size of the round bar test specimen is such that a diameter is 6.35 mm, and the length of a parallel portion is 25.4 mm, for example. The axial direction of the round bar test specimen is parallel to the rolling direction of the steel material.

A mixed aqueous solution containing 5.0 mass % of sodium chloride and 0.5 mass % of acetic acid (NACE solution A) at 24° C. is employed as a test solution. A stress equivalent to 90% of the actual yield stress is applied to the round bar test specimen. The test solution at 24° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath where saturation of the $H_2S$ gas is caused is held for 720 hours at 24° C.

On the other hand, in the four-point bending test, a test specimen is taken from the steel material according to the present embodiment. In the case where the steel material is a steel plate, the test specimen is taken from a center portion of the thickness. In the case where the steel material is a steel pipe, the test specimen is taken from the center portion of the wall thickness. The size of the test specimen is such that the thickness is 2 mm, a width is 10 mm, and a length is 75 mm, for example. The length direction of the test specimen is parallel to the rolling direction of the steel material.

An aqueous solution containing 5.0 mass % of sodium chloride at 24° C. is employed as the test solution. In accordance with ASTM G39-99 (2011), stress is applied to the test specimens by four-point bending so that the stress applied to each test specimen becomes 90% of the actual yield stress. The test specimen to which stress has been applied is enclosed in an autoclave, together with the test jig. The test solution is poured into the autoclave in a manner so as to leave a vapor phase portion, and adopted as the test bath. After the test bath is degassed, 15 atm $H_2S$ gas is sealed under pressure in the autoclave, and the test bath is stirred to cause the $H_2S$ gas to saturate. After sealing the autoclave, the test bath is stirred for 720 hours at 24° C.

In the steel material according to the present embodiment, cracking is not confirmed after 720 hours elapses in both the method in accordance with "Method A" and the four-point bending test. Note that, in the present description, the term "cracking is not confirmed" means that cracking is not confirmed in a test specimen in a case where the test specimen after the test was observed by the naked eye.

[Shape of Steel Material]

The shape of the steel material according to the present embodiment is not particularly limited. The steel material may be a steel pipe or a steel plate, for example. In the case where the steel material is an oil-well steel pipe, a preferable wall thickness is 9 to 60 mm. More preferably, the steel material according to the present embodiment is suitable for use as a heavy-wall seamless steel pipe. More specifically, even when the steel material according to the present embodiment is a seamless steel pipe having a wall thickness of 15 mm or more or, furthermore, 20 mm or more, the steel material exhibits the yield strength of 110 ksi grade and excellent SSC resistance.

[Production Method]

A method for producing the steel material according to the present embodiment will be described. The production method described hereinafter is a method for producing a seamless steel pipe, which is one example of the steel material according to the present embodiment. Note that the method for producing the steel material according to the present embodiment is not limited to the production method which will be described hereinafter.

[Preparing Process]

In a preparing process, an intermediate steel material having the aforementioned chemical composition is prepared. Provided that the intermediate steel material has the aforementioned chemical composition, a method for producing the intermediate steel material is not particularly limited. In the present embodiment, in the case where an end product is a steel plate, the intermediate steel material is a plate-shaped steel material. Meanwhile in the case where the end product is a steel pipe, the intermediate steel material is a hollow shell.

The preparing process may preferably include a process of preparing a starting material (starting material preparing process), and a process of producing an intermediate steel material by performing hot working on the starting material (hot working process). Hereinafter, the case where the preparing process includes the starting material preparing process and the hot working process will be described in detail.

[Starting Material Preparing Process]

In the starting material preparing process, a starting material is produced using molten steel having the aforementioned chemical composition. Specifically, a cast piece (slab, bloom, or billet) is produced by a continuous casting process using molten steel. An ingot may be produced by an ingot-making process using molten steel. A billet may be produced by blooming a slab, bloom or ingot when necessary. The starting material (slab, bloom, or billet) is produced via the aforementioned processes.

[Hot Working Process]

In the hot working process, hot working is performed on the prepared starting material, thus producing an intermediate steel material. In the case where the steel material is a steel pipe, the intermediate steel material corresponds to a hollow shell. First, a billet is heated in a heating furnace. The heating temperature is not particularly limited, for example, the heating temperature may be 1100 to 1300° C. Hot working is performed on the billet extracted from the heating furnace to produce a hollow shell (seamless steel pipe).

For example, the Mannesmann process may be performed for hot working to produce a hollow shell. In this case, a round billet is subject to piercing-rolling by a piercing machine. In the case of performing piercing-rolling, a piercing ratio is not particularly limited, for example, the piercing ratio may be 1.0 to 4.0. The round billet on which piercing-rolling is performed is further subject to hot rolling by a mandrel mill, a reducer, a sizing mill or the like, thus forming a hollow shell. The cumulative reduction of area in the hot working process is, for example, 20 to 70%.

A hollow shell may be produced from a billet by another hot working method. For example, in the case of a heavy-wall steel material having a short length, such as coupling, a hollow shell may be produced by performing forging by the Ehrhardt method or the like. The hollow shell is produced via the aforementioned processes. The wall thickness of a hollow shell to be produced is not particularly limited, for example, the wall thickness may be 9 to 60 mm.

The hollow shell produced by hot working may be air-cooled (As-Rolled). The hollow shell produced by hot working may be subjected to direct quenching after hot working without being cooled to normal temperature, or may be subjected to quenching after undergoing supplementary heating (reheating) after hot working.

In the case where direct quenching is performed or quenching is performed after supplementary heating is performed, stopping of cooling or slow cooling may be performed during quenching. In this case, it is possible to suppress the occurrence of quenching cracks in the hollow shell. In the case where direct quenching is performed or quenching is performed after supplementary heating is performed, a stress relief treatment (SR treatment) may be further performed after quenching and before heat treatment (tempering or the like) which is a next process. In this case, residual stress in the hollow shell is removed.

As described above, the intermediate steel material is prepared in the preparing process. The intermediate steel material may be produced by the aforementioned preferred processes, or may be an intermediate steel material produced by a third party, or an intermediate steel material that was produced in another factory other than the factory where a quenching process and a tempering process described later are performed, or at a different works.

[Heat Treatment Process]

In the heat treatment process, heat treatment is performed on the prepared intermediate steel material. Specifically, quenching and tempering are performed on the prepared intermediate steel material. In the present description, "quenching" means to rapidly cool an intermediate steel material at the temperature of the $A_3$ point or more. In the present description, "tempering" means to reheat and hold the quenched intermediate steel material at the temperature of the $A_{c1}$ point or less.

In the heat treatment process according to the present embodiment, it is preferable to perform quenching and tempering a plurality of times. Specifically, it is preferable to perform each of quenching and tempering two or more times. More specifically, it is preferable that quenching is performed and, thereafter, tempering is performed on the prepared intermediate steel material. Further, quenching is performed and, then, tempering is performed on the prepared intermediate steel material.

Note that, in the heat treatment process according to the present embodiment, quenching and tempering may be performed three or more times. However, even if quenching and tempering are repeatedly performed four or more times, the advantageous effects obtained by performing the heat treatment saturates. Accordingly, in the heat treatment process according to the present embodiment, it is preferable to perform quenching and tempering two or three times. Hereinafter, quenching and tempering will be described in detail.

[Quenching]

Quenching is performed on the prepared intermediate steel material (hollow shell) and/or the intermediate steel material on which tempering is performed. In the heat treatment process according to the present embodiment, a preferred quenching temperature is 800 to 1000° C. In the present description, "quenching temperature" corresponds to the surface temperature of the intermediate steel material measured by a thermometer installed on the exit side of an apparatus which performs final hot working in the case where direct quenching is performed after hot working is performed. The quenching temperature also corresponds to a temperature of a supplementary heating furnace or a heat treatment furnace in the case where quenching is performed using the holding furnace or the heat treatment furnace after hot working is performed.

That is, in the heat treatment process according to the present embodiment, quenching may be performed by rapidly cooling the intermediate steel material at 800 to 1000° C. after hot working is performed. Quenching may be performed such that the intermediate steel material on which hot working is performed is heated to 800 to 1000° C. using the supplementary heating furnace or the heat treatment furnace and, then, is rapidly cooled. Alternatively, quenching may be performed such that the intermediate steel material on which tempering is performed is heated to 800 to 1000° C. using the heat treatment furnace and, then, is rapidly cooled.

When the quenching temperature is too high, there may be a case where prior γ grain is coarsened, thus reducing SSC resistance of a steel material. Accordingly, quenching temperature is preferably set to 800 to 1000° C. A more preferable upper limit of the quenching temperature is 950° C.

In the heat treatment process according to the present embodiment, in the case where quenching is performed using the supplementary heating furnace or the heat treatment furnace after hot working is performed, a preferred quenching time is 5 to 20 minutes. In the present description, "quenching time" means a time from a point of time when an intermediate steel material is charged into the supplementary heating furnace or the heat treatment furnace to a point of time when the intermediate steel material is taken out.

In the case where quenching is performed using the supplementary heating furnace or the heat treatment furnace after hot working is performed, if the quenching time is too long, prior γ grain may be coarsened after last tempering is performed. Accordingly, in the case where quenching is performed using the supplementary heating furnace or the heat treatment furnace after hot working is performed in the heat treatment process according to the present embodiment, it is preferable to set the quenching time to 5 to 20 minutes.

For example, a quenching method may be adopted where a hollow shell is continuously cooled from a temperature at which quenching is started to continuously reduce the temperature of the hollow shell. The method for a continuous cooling process is not particularly limited, and a well-known method may be adopted. The method for the continuous cooling process may be a method where a hollow shell is immersed into a water tank to cool, or a method where a hollow shell is cooled by shower water or is cooled by mist to perform accelerated cooling.

When a cooling speed during quenching is too low, a microstructure which is principally composed of martensite and bainite cannot be obtained so that mechanical property which is defined in the present embodiment cannot be obtained. Accordingly, in the method for producing a steel material according to the present embodiment, an intermediate steel material (hollow shell) is rapidly cooled during quenching. Specifically, in the quenching process, an average cooling speed when the temperature of the intermediate steel material (hollow shell) during quenching falls within a range of 800 to 500° C. is defined as a cooling speed during quenching $CR_{800\text{-}500}$ (° C./sec). More specifically, the cooling speed during quenching $CR_{800\text{-}500}$ is decided from a temperature measured on the surface of the quenched intermediate steel material.

A preferred cooling speed during quenching $CR_{800\text{-}500}$ is 8° C./sec or more. In this case, the microstructure of an intermediate steel material (hollow shell) on which quenching is performed is principally composed of martensite and bainite in a stable manner. A preferable lower limit of the cooling speed during quenching $CR_{800\text{-}500}$ is 10° C./sec. A preferable upper limit of the cooling speed during quenching $CR_{800\text{-}500}$ is 500° C./sec.

[Tempering]

Tempering is performed on the intermediate steel material on which the aforementioned quenching is performed. In performing tempering on a steel material which is expected to be used in a sour environment, a tempering temperature and a tempering time are adjusted according to the chemical composition of the steel material and yield strength which is expected to be obtained. In this case, only last tempering is controlled and, conventionally, it is considered sufficient to set a tempering temperature to $A_{c1}$ point or less during tempering other than last tempering.

On the other hand, in the steel material according to the present embodiment, prior γ grain is made fine by increasing Mo content. With respect to this mechanism, as described above, it is considered that the dissolved Mo in the steel material segregates in austenite grain boundaries during heating in a quenching process, thus making prior γ grain after tempering fine by a pinning effect. In the present embodiment, Mo is liable to form $M_2C$ carbide in the steel material having the aforementioned chemical composition. Further, in the steel material having the aforementioned chemical composition, $M_2C$ carbide is liable to be precipitated during tempering.

In view of the above, in the heat treatment process according to the present embodiment, the sufficient amount of Mo is dissolved in a steel material on which second last tempering is performed. Specifically, in the heat treatment process according to the present embodiment, a tempering parameter $TMP_2$ (=(tempering temperature (° C.)+273)×(log (tempering time (min)/60)+20)) is controlled during second last tempering, and thereby it is possible to reduce the amount of Mo which is precipitated as $M_2C$ carbide.

More specifically, in the steel material having the aforementioned chemical composition, when the tempering parameter $TMP_2$ during the second last tempering is 15000 to 19000, it is possible to make the prior γ grain diameter in the steel material on which last tempering is performed fine. When the tempering parameter $TMP_2$ during the second last tempering is less than 15000, there may be a case where advantageous effects of tempering cannot be sufficiently obtained so that quenching cracks or season cracks occur in the steel material. On the other hand, when the tempering parameter $TMP_2$ during the second last tempering is more than 19000, there may be a case where the sufficient amount of dissolved Mo cannot be obtained during heating in the last quenching so that a prior γ grain on which last tempering is performed is coarsened.

Accordingly, in the heat treatment process according to the present embodiment, a preferable tempering parameter $TMP_2$ during the second last tempering is 15000 to 19000. A more preferable lower limit of the tempering parameter $TMP_2$ during the second last tempering is 15500, and further preferably is 16000. A more preferable upper limit of the tempering parameter $TMP_2$ during second last tempering is 18500, and further preferably is 18000.

In the second last tempering, a preferable tempering temperature is 500 to less than 700° C. In the second last tempering, a more preferable tempering time (holding time) is 10 to 60 minutes. That is, in the present embodiment, in the second last tempering, the tempering temperature is set to 500 to less than 700° C., and the tempering time is set to 10 to 60 minutes, and further, the tempering parameter $TMP_2$ is set to 15000 to 19000.

Note that, "tempering temperature" in the present description corresponds to a temperature of a heat treatment furnace at the time of heating and holding an intermediate steel material on which quenching is performed. In the present description, a tempering time (holding time) means a time from a point of time when the intermediate steel material is charged into the heat treatment furnace for heating and holding the intermediate steel material on which quenching is performed to a point of time when the intermediate steel material is taken out.

Further, in the present description, "second last tempering" means tempering performed before last quenching and tempering. That is, in the case where each of quenching and tempering is performed two times in the heat treatment process, second last tempering means the first tempering. In the case where each of quenching and tempering is performed three times in the heat treatment process, second last tempering means the second tempering.

The steel material according to the present embodiment further reduces coarse specific precipitates of precipitates which are precipitated in the prior γ grain boundaries (specific precipitates). As described above, most of the specific precipitates are carbide. Therefore, most of the specific precipitates are precipitated in last tempering. Accordingly, in the heat treatment process according to the present embodiment, not only the tempering parameter $TMP_2$ during second last tempering, but also a tempering parameter $TMP_1$ during last tempering (=(tempering temperature (° C.)+273)×(log (tempering time (min)/60)+20)) are controlled.

More specifically, in the steel material having the aforementioned chemical composition, provided that the tempering parameter $TMP_1$ during the last tempering is 19100 to 19600, coarse specific precipitates can be reduced in the steel material on which last tempering is performed. When the tempering parameter $TMP_1$ during last tempering is less than 19100, there may be a case where advantageous effects of tempering cannot be sufficiently obtained, and yield strength of a steel material on which tempering is performed becomes too high. When the tempering parameter $TMP_1$ during last tempering is less than 19100, there may be also a case where a large amount of coarse specific precipitates is precipitated.

On the other hand, when the tempering parameter $TMP_1$ during last tempering is more than 19600, there may be a case where yield strength of a steel material on which tempering is performed becomes too low. When the tempering parameter $TMP_1$ during last tempering is more than 19600, there may be also a case where a large amount of coarse specific precipitates is precipitated.

Accordingly, in the heat treatment process according to the present embodiment, a preferable tempering parameter $TMP_1$ during the last tempering is 19100 to 19600. A more preferable lower limit of the tempering parameter $TMP_1$ during last tempering is 19200, and further preferably is 19300. A more preferable upper limit of the tempering parameter $TMP_1$ during last tempering is 19570, and further preferably is 19500.

In the last tempering, a preferable tempering temperature is 650 to 730° C. In the last tempering, a preferable tempering time (holding time) is 10 to 90 minutes. That is, in the present embodiment, in the last tempering, the tempering temperature is set to 650 to 730° C., and the tempering time is set to 10 to 90 minutes and further, the tempering parameter $TMP_1$ is set to 19100 to 19600.

In the case where the steel material is a steel pipe, variation is liable to occur in temperature of the steel pipe during holding in tempering compared with another shape. Accordingly, in the case where the steel material is a steel pipe, a preferable tempering time is 15 to 90 minutes. It is sufficiently possible for those skilled in the art to set yield strength to 758 to 862 MPa (110 ksi grade) by appropriately adjusting the aforementioned tempering temperature and the aforementioned tempering time of the steel material having the chemical composition of the present embodiment.

The steel material according to the present embodiment can be produced by the aforementioned production method. In the aforementioned production method, the method for producing a seamless steel pipe has been described as one example. However, the steel material according to the present embodiment may be a steel plate, or may have another shape. In the same manner as the aforementioned production method, the method for producing a steel plate or a product having another shape also includes a preparing process and a heat treatment process, for example. Further, the aforementioned production method merely forms one example, and the steel material may be produced by another production method.

Examples

Molten steels having the chemical composition shown in Table 1 were produced. F1 for each steel was also acquired from the chemical composition described in Table 1. Note that "-" in Table 1 means that content of each element is at the level of an impurity.

TABLE 1

| | Chemical composition (unit being mass %, balance being Fe and impurities) | | | | | | | | | | | |
|---|---|---|---|---|---|---|---|---|---|---|---|---|
| Steel | C | Si | Mn | P | S | Cr | Mo | Al | N | Ti | Nb | V |
| A | 0.24 | 0.27 | 0.42 | 0.012 | 0.0007 | 0.98 | 0.92 | 0.034 | 0.0054 | 0.009 | 0.035 | 0.10 |
| B | 0.26 | 0.25 | 0.43 | 0.013 | 0.0008 | 0.76 | 0.85 | 0.033 | 0.0059 | 0.007 | 0.036 | 0.10 |
| C | 0.25 | 0.25 | 0.42 | 0.012 | 0.0006 | 0.74 | 0.95 | 0.035 | 0.0060 | 0.006 | 0.029 | 0.10 |
| D | 0.25 | 0.26 | 0.37 | 0.012 | 0.0005 | 1.01 | 0.97 | 0.035 | 0.0057 | 0.006 | 0.029 | 0.10 |
| E | 0.25 | 0.27 | 0.43 | 0.011 | 0.0006 | 0.90 | 0.91 | 0.035 | 0.0046 | 0.010 | 0.030 | 0.10 |
| F | 0.27 | 0.26 | 0.42 | 0.011 | 0.0006 | 0.71 | 0.75 | 0.033 | 0.0041 | 0.010 | 0.040 | 0.11 |
| G | 0.27 | 0.27 | 0.41 | 0.011 | 0.0005 | 0.62 | 0.95 | 0.032 | 0.0047 | 0.010 | 0.030 | 0.12 |
| H | 0.26 | 0.26 | 0.41 | 0.010 | 0.0007 | 0.62 | 0.95 | 0.038 | 0.0046 | 0.010 | 0.040 | 0.11 |
| I | 0.24 | 0.25 | 0.07 | 0.012 | 0.0006 | 0.85 | 0.82 | 0.030 | 0.0051 | 0.010 | 0.030 | 0.11 |
| J | 0.25 | 0.32 | 0.41 | 0.011 | 0.0009 | 1.02 | 0.81 | 0.029 | 0.0044 | 0.008 | 0.029 | 0.11 |
| K | 0.25 | 0.26 | 0.41 | 0.011 | 0.0005 | 1.02 | 0.77 | 0.038 | 0.0039 | 0.005 | 0.027 | 0.10 |
| L | 0.26 | 0.25 | 0.40 | 0.010 | 0.0005 | 1.01 | 0.89 | 0.039 | 0.0037 | 0.005 | 0.026 | 0.10 |
| M | 0.24 | 0.25 | 0.42 | 0.010 | 0.0008 | 0.50 | 1.16 | 0.031 | 0.0043 | 0.006 | 0.026 | 0.09 |
| N | 0.27 | 0.30 | 0.45 | 0.008 | 0.0012 | 1.05 | 0.30 | 0.035 | 0.0035 | 0.006 | 0.027 | 0.10 |
| O | 0.27 | 0.25 | 0.41 | 0.011 | 0.0007 | 1.20 | 0.90 | 0.037 | 0.0047 | 0.010 | 0.040 | 0.12 |
| P | 0.26 | 0.25 | 0.42 | 0.011 | 0.0006 | 0.42 | 0.80 | 0.031 | 0.0042 | 0.010 | 0.030 | 0.11 |
| Q | 0.25 | 0.25 | 0.42 | 0.012 | 0.0008 | 0.61 | 0.56 | 0.032 | 0.0041 | 0.009 | 0.026 | 0.11 |
| R | 0.24 | 0.26 | 0.43 | 0.011 | 0.0007 | 0.63 | 0.60 | 0.039 | 0.0052 | 0.008 | 0.029 | 0.10 |

| Steel | B | O | Ca | Mg | Zr | REM | Cu | Ni | Co | W | F1 |
|---|---|---|---|---|---|---|---|---|---|---|---|
| A | 0.0011 | 0.0015 | — | — | — | — | — | — | — | — | 0.94 |
| B | 0.0011 | 0.0019 | 0.0012 | — | — | — | — | — | — | — | 1.12 |
| C | 0.0010 | 0.0019 | 0.0012 | — | — | — | — | — | — | — | 1.28 |
| D | 0.0009 | 0.0017 | — | 0.0050 | — | — | — | — | — | — | 0.96 |
| E | 0.0011 | 0.0013 | — | — | 0.0030 | — | 0.03 | 0.04 | — | — | 1.01 |
| F | 0.0010 | 0.0010 | — | — | — | 0.0070 | — | — | — | — | 1.06 |
| G | 0.0010 | 0.0010 | — | — | — | — | 0.03 | — | 0.20 | — | 1.53 |
| H | 0.0011 | 0.0011 | — | — | — | — | 0.03 | 0.04 | — | 0.25 | 1.53 |
| I | 0.0012 | 0.0015 | 0.0012 | — | — | — | 0.03 | 0.04 | — | — | 0.96 |
| J | 0.0010 | 0.0018 | — | — | — | — | — | — | — | — | 0.79 |
| K | 0.0011 | 0.0013 | 0.0015 | — | — | — | — | — | — | — | 0.75 |
| L | 0.0012 | 0.0010 | 0.0017 | — | — | — | — | — | — | — | 0.88 |
| M | 0.0012 | 0.0019 | — | — | — | — | — | — | — | — | 2.32 |
| N | 0.0012 | 0.0009 | — | — | — | — | — | — | — | — | 0.29 |
| O | 0.0010 | 0.0011 | — | — | — | — | — | 0.04 | — | — | 0.75 |
| P | 0.0010 | 0.0011 | — | — | — | — | 0.03 | — | — | — | 1.90 |
| Q | 0.0009 | 0.0016 | — | — | — | — | — | — | — | — | 0.92 |
| R | 0.0010 | 0.0015 | — | — | — | — | — | — | — | — | 0.95 |

Billets were produced using the aforementioned molten steels by a continuous casting process. The produced billets of respective test numbers were held for one hour at 1250° C., and thereafter hot rolling (hot working) was performed on the billets by the Mannesmann-mandrel method to produce hollow shells (seamless steel pipes) of respective test numbers.

Heat treatment (quenching and tempering) was performed two times on each of the hollow shells of respective test numbers on which hot working was performed. Specifically, heat treatment was performed on the hollow shells of respective test numbers by the following method.

The hollow shells of respective test numbers produced by performing hot working were held for 5 minutes in a supplementary heating furnace at 950° C., and thereafter direct quenching (that is, first quenching) was performed. All of cooling speeds during quenching $CR_{800-500}$ in first quenching for respective test numbers were within a range of 8 to 500° C./sec. Note that the cooling speed during quenching $CR_{800-500}$ was acquired by measuring the surface temperature of the hollow shell of each test number.

Subsequently, first tempering, that is, second last tempering was performed on the hollow shells of respective test numbers. Specifically, on the hollow shell of each test number, tempering was performed where each hollow shell is held at the tempering temperature (° C.) for the tempering time (min) described in the column of "second last tempering" in Table 2. The tempering parameters $TMP_2$ (=(tempering temperature (° C.)+273)×(log (tempering time (min)/60)+20)) during second last tempering are also shown in Table 2.

TABLE 2

| | | Second last tempering | | | Last quenching | | Last tempering | | | | | | | SSC resistance | |
|---|---|---|---|---|---|---|---|---|---|---|---|---|---|---|---|
| Test No. | Steel | Tempering temperature (° C.) | Tempering time (min) | $TMP_2$ | Quenching temperature (° C.) | Quenching time (min) | Tempering temperature (° C.) | Tempering time (min) | $TMP_1$ | YS (MPa) | TS (MPa) | Prior γ grain diameter (μm) | Average area of specific precipitates ($\times 10^{-3}$ μm$^2$) | 1 atm $H_2S$ | 15 atm $H_2S$ |
| 1 | A | 550 | 30 | 16212 | 920 | 15 | 700 | 60 | 19460 | 831 | 901 | 13.5 | 8.9 | E | E |
| 2 | B | 550 | 30 | 16212 | 920 | 15 | 700 | 60 | 19460 | 837 | 903 | 13.1 | 7.6 | E | E |
| 3 | C | 550 | 30 | 16212 | 920 | 15 | 700 | 60 | 19460 | 832 | 904 | 13.9 | 7.2 | E | E |
| 4 | D | 550 | 30 | 16212 | 920 | 15 | 700 | 60 | 19460 | 832 | 904 | 14.1 | 9.9 | E | E |
| 5 | E | 550 | 30 | 16212 | 920 | 15 | 700 | 60 | 19460 | 845 | 916 | 12.7 | 7.7 | E | E |
| 6 | F | 550 | 30 | 16212 | 920 | 15 | 700 | 60 | 19460 | 832 | 910 | 11.9 | 6.9 | E | E |
| 7 | G | 550 | 30 | 16212 | 920 | 15 | 700 | 60 | 19460 | 832 | 912 | 12.9 | 8.3 | E | E |
| 8 | H | 550 | 30 | 16212 | 920 | 15 | 700 | 60 | 19460 | 841 | 917 | 13.1 | 9.2 | E | E |
| 9 | I | 550 | 30 | 16212 | 920 | 15 | 700 | 60 | 19460 | 843 | 917 | 13.2 | 9.4 | E | E |
| 10 | J | 550 | 30 | 16212 | 920 | 15 | 700 | 60 | 19460 | 819 | 896 | 12.5 | 14.2 | NA | E |
| 11 | K | 550 | 30 | 16212 | 920 | 15 | 700 | 60 | 19460 | 839 | 913 | 12.5 | 13.5 | NA | E |
| 12 | L | 550 | 30 | 16212 | 920 | 15 | 700 | 60 | 19460 | 825 | 907 | 12.4 | 12.9 | NA | E |
| 13 | M | 550 | 30 | 16212 | 920 | 15 | 700 | 60 | 19460 | 804 | 874 | 13.5 | 6.5 | E | NA |
| 14 | N | 600 | 30 | 17197 | 920 | 15 | 695 | 60 | 19360 | 793 | 874 | 20.6 | 13.0 | NA | NA |
| 15 | O | 550 | 30 | 16212 | 920 | 15 | 700 | 60 | 19460 | 836 | 904 | 12.6 | 7.8 | NA | NA |
| 16 | P | 550 | 30 | 16212 | 920 | 15 | 700 | 60 | 19460 | 849 | 905 | 13.9 | 14.2 | NA | E |
| 17 | Q | 550 | 30 | 16212 | 920 | 15 | 700 | 60 | 19460 | 826 | 901 | 17.1 | 9.5 | NA | NA |
| 18 | R | 550 | 30 | 16212 | 920 | 15 | 700 | 60 | 19460 | 835 | 903 | 16.3 | 8.5 | NA | NA |
| 19 | B | 700 | 30 | 19167 | 920 | 15 | 700 | 60 | 19460 | 798 | 887 | 20.5 | 11.5 | NA | NA |
| 20 | C | 700 | 30 | 19167 | 920 | 15 | 700 | 60 | 19460 | 789 | 867 | 22.9 | 12.2 | NA | NA |
| 21 | D | 700 | 30 | 19167 | 920 | 15 | 690 | 30 | 18970 | 875 | 935 | 14.5 | 13.2 | NA | NA |
| 22 | D | 700 | 30 | 19167 | 920 | 15 | 700 | 100 | 19676 | 798 | 874 | 14.3 | 13.4 | NA | E |

Second quenching, that is, last quenching was performed on the hollow shells of respective test numbers on which the aforementioned first tempering was performed. Specifically, the hollow shell of each test number was held at the quenching temperature (° C.) for the quenching time (min) described in the column of "last quenching" in Table 2 and, thereafter, quenching was performed on the hollow shell. All cooling speed during quenching $CR_{800\text{-}500}$ in second quenching for respective test numbers were within a range of 8 to 500° C./sec.

In addition to the above, second tempering, that is, last tempering was performed on the hollow shells of respective test numbers on which last quenching was performed. Specifically, on the hollow shell of each test number, tempering was performed where each hollow shell was held at the tempering temperature (° C.) for the tempering time (min) described in the column of "last tempering" in Table 2. The tempering parameters $TMP_1$ during last tempering (=(tempering temperature (° C.)+273)×(log (tempering time (min)/60)+20)) are shown in Table 2.

Note that, in the present example, the temperature of the supplementary heating furnace or the heat treatment furnace used for heating in quenching corresponded to "quenching temperature (° C.)". Further, the temperature of the heat treatment furnace used in tempering corresponded to "tempering temperature (° C.)". Further, a time from a point of time when the hollow shell is charged into the holding furnace or the heat treatment furnace at the time of heating the hollow shell in a quenching process to a point of time when the hollow shell is taken out corresponded to "quenching time (min)". A time from a point of time when the hollow shell is charged into the heat treatment furnace at the time of performing tempering to a point of time when the hollow shell is taken out corresponded to "tempering time (min)".

[Evaluation Test]

The microstructure observation, the tensile test, and the SSC resistance evaluation test, which will be described below, were performed on the seamless steel pipes of respective test numbers on which tempering treatment was performed.

[Microstructure Observation]

A prior γ grain diameter in the seamless steel pipe of each test number was measured by the aforementioned method. The prior γ grain diameters (μm) of the seamless steel pipes of respective test numbers are shown in Table 2. With respect to the seamless steel pipe of each test number, the average area of precipitates which was precipitated in prior γ grain boundaries (specific precipitates) was also acquired by the aforementioned method. The average areas of the specific precipitates ($\times 10^{-3}$ μm$^2$) in the seamless steel pipes of respective test numbers are shown in Table 2.

[Tensile Test]

Yield strength of the seamless steel pipe of each test number was measured by the aforementioned method. Specifically, a tensile test was performed in accordance with ASTM E8/E8M (2013). More specifically, a round bar tensile specimen having a parallel portion with a diameter of 8.9 mm and a length of 35.6 mm was prepared from the center portion of the wall thickness of the seamless steel pipe of each test number. The axial direction of the round bar tensile specimen was parallel to the axial direction of the seamless steel pipe.

A tensile test was performed using the round bar test specimen of each test number in the atmosphere at normal temperature (25° C.) to acquire yield strength (MPa) of the seamless steel pipe of each test number. Note that, in the present example, stress at 0.7% elongation acquired in the tensile test was defined as yield strength of each test number. The acquired yield strength YS (MPa) and tensile strength TS (MPa) are shown in Table 2.

[SSC Resistance Evaluation Test of Steel Material]

Using the seamless steel pipes of respective test numbers, a test in accordance with "Method A" specified in NACE TM0177-2005, and a four-point bending test were performed to evaluate SSC resistance. Specifically, the test in accordance with "Method A" specified in NACE TM0177-2005 was performed by the following method.

Three round bar test specimens each of which has a diameter of 6.35 mm and a parallel portion with a length of 25.4 mm were taken from the center portion of the wall thickness of the seamless steel pipe of each test number. Each round bar test specimen was taken such that the axial direction of the round bar test specimen is parallel to the axial direction of the seamless steel pipe. Tensile stress in the axial direction of the round bar test specimen was applied to the round bar test specimen of each test number. At this point of operation, adjustment was performed such that stress to be applied is 90% of actual yield stress of the seamless steel pipe of each test number.

A mixed aqueous solution containing 5.0 mass % of sodium chloride and 0.5 mass % of acetic acid (NACE solution A) was used as the test solution. The test solution at 24° C. was poured into three test vessels, and these were adopted as test baths. The three round bar test specimens to which the stress was applied were immersed individually in mutually different test vessels as the test baths. After each test bath was degassed, $H_2S$ gas at 1 atm was blown into the respective test baths and caused to saturate. The test baths in which the $H_2S$ gas at 1 atm was saturated were held at 24° C. for 720 hours.

Meanwhile, the four-point bending test was performed by the following method. Three test specimens each of which has a thickness of 2 mm, a width of 10 mm, and a length of 75 mm, were taken from the center portion of the seamless steel pipe of each test numbers of the wall thickness. The test specimen was taken such that the longitudinal direction of the test specimen is parallel to the axial direction of the seamless steel pipe. Stress was applied to the test specimens of each test number by four-point bending in accordance with ASTM G39-99 (2011) such that stress applied to each test specimen is 90% of actual yield stress of the seamless steel pipe of each test number. The test specimen to which stress was applied was sealed into an autoclave together with a test jig.

An aqueous solution containing 5.0 mass % of sodium chloride was used as the test solution. The test solution was poured into the autoclave while maintaining a gas phase portion, thus preparing test bath. After the test bath was degassed, $H_2S$ gas at 15 atm was pressure-sealed, and the test bath was stirred to cause saturation of $H_2S$ gas in the test bath. After the autoclave was sealed, the test bath was stirred for 720 hours at 24° C.

In each of the aforementioned test in accordance with "Method A" specified in NACE TM0177-2005, and the four-point bending test, the test specimens of respective test numbers after being held for 720 hours were observed with respect to presence or absence of the occurrence of sulfide stress cracks (SSC). Specifically, the test specimens which were held for 720 hours were observed with the naked eyes. As a result of observation, a test number for which cracking was not confirmed in all of the test specimens was determined as "E" (Excellent). On the other hand, a test number for which cracking was confirmed in at least one test specimen was determined as "NA" (Not Acceptable).

[Test Result]

Table 2 shows the test results. With respect to the SSC resistance test, the results of the test in accordance with "Method A" specified in NACE TM0177-2005 are shown in the column of "1 atm $H_2S$", and the results of the four-point bending test are shown in the column of "15 atm $H_2S$".

Referring to Table 1 and Table 2, in the seamless steel pipes of Test Numbers 1 to 9, the chemical composition was appropriate, yield strength was 758 to 862 MPa, the prior γ grain diameter was 15.0 μm or less, and the average area of the specific precipitates was $12.5\times10^3$ $\mu m^2$ or less. As a result, excellent SSC resistance was shown in both the test in accordance with "Method A" specified in NACE TM0177-2005 and the four-point bending test.

On the other hand, in the seamless steel pipes of Test Numbers 10 to 12, F1 was too low. Therefore, the average area of the specific precipitates was more than $12.5\times10^{-3}$ $m^2$. As a result, excellent SSC resistance was not shown in the test in accordance with "Method A" specified in NACE TM0177-2005.

In the seamless steel pipe of Test Number 13, the Cr content was too low. Also, the Mo content was too high. As a result, excellent SSC resistance was not shown in the four-point bending test.

In the seamless steel pipe of Test Number 14, the Mo content was too low. In addition, F1 was too low. Therefore, the priory grain diameter was more than 15.0 μm. Accordingly, the average area of the specific precipitates was also more than $12.5\times10^{-3}$ $\mu m^2$. As a result, excellent SSC resistance was not shown in either the test in accordance with "Method A" specified in NACE TM0177-2005 or the four-point bending test.

In the seamless steel pipe of Test Number 15, the Cr content was too high. In addition, F1 was too low. As a result, excellent SSC resistance was not shown in either the test in accordance with "Method A" specified in NACE TM0177-2005 or the four-point bending test.

In the seamless steel pipe of Test Number 16, the Cr content was too low. Therefore, the average area of the specific precipitates was also more than $12.5\times10^{-3}$ $\mu m^2$. As a result, excellent SSC resistance was not shown in the test in accordance with "Method A" specified in NACE TM0177-2005.

In the seamless steel pipes of Test Numbers 17 and 18, the Mo content was too low. Therefore, the prior γ grain diameter was more than 15.0 μm. As a result, excellent SSC resistance was not shown in either the test in accordance with "Method A" specified in NACE TM0177-2005 or the four-point bending test.

In the seamless steel pipes of Test Numbers 19 and 20, the tempering parameter $TMP_2$ during second last tempering was too high. Therefore, the prior γ grain diameter was more than 15.0 μm. As a result, excellent SSC resistance was not shown in either the test in accordance with "Method A" specified in NACE TM0177-2005 or the four-point bending test.

In the seamless steel pipe of Test Number 21, the tempering parameter $TMP_2$ during second last tempering was too high. In addition, the tempering parameter $TMP_1$ during second last tempering was too low. Therefore, the average area of the specific precipitates was also more than $12.5\times10^{-3}$ $\mu m^2$. As a result, yield strength was more than 862 MPa so that yield strength of 110 ksi grade was not obtained. As a result, excellent SSC resistance was not shown in either the test in accordance with "Method A" specified in NACE TM0177-2005 or the four-point bending test.

In the seamless steel pipe of Test Number 22, the tempering parameter $TMP_2$ during second last tempering was too high. In addition, the tempering parameter $TMP_1$ during second last tempering was too high. Therefore, the average area of the specific precipitates was more than $12.5\times10^{-3}$ $\mu m^2$. As a result, excellent SSC resistance was not shown in the test in accordance with "Method A" specified in NACE TM0177-2005.

An embodiment of the present invention has been described above. However, the embodiment described above is merely an example for implementing the present invention. Accordingly, the present invention is not limited to the above embodiment, and the above embodiment can be appropriately modified and performed within a range that does not deviate from the gist of the present invention.

INDUSTRIAL APPLICABILITY

The steel material according to the present invention is widely applicable for steel materials utilized in a severe environment, such as a polar region. It is preferable that the steel material according to the present invention can be used as a steel material utilized in an oil well environment. It is more preferable that the steel material according to the present invention can be used as a steel material, such as a casing pipe, a tubing pipe, or a line pipe.

The invention claimed is:

1. A steel material comprising:
a chemical composition consisting of, in mass %:
C: 0.15 to 0.45%,
Si: 0.05 to 1.00%,
Mn: 0.01 to 1.00%,
P: 0.030% or less,
S: 0.0050% or less,
Al: 0.005 to 0.100%,
Cr: 0.55 to 1.10%,
Mo: 0.70 to 1.00%,
Ti: 0.002 to 0.020%,
V: 0.05 to 0.30%,
Nb: 0.002 to 0.100%,
B: 0.0005 to 0.0040%,
N: 0.0100% or less,
O: less than 0.0020%,
Ca: 0 to 0.0100%,
Mg: 0 to 0.0100%,
Zr: 0 to 0.0100%,
rare earth metal: 0 to 0.0100%,
Cu: 0 to 0.50%,
Ni: 0 to 0.50%,
Co: 0 to 0.50%, and
W: 0 to 0.50%,
with the balance being Fe and impurities,
and satisfying Formula (1),
wherein
in the steel material, a grain diameter of a prior-austenite grain is 15.0 μm or less,
an average area of precipitate which is precipitated in a prior-austenite grain boundary is $12.5\times10^{-3}$ $\mu m^2$ or less, and
a yield strength is 758 to 862 MPa:

$$Mo/Cr \geq 1.90 \quad (1)$$

where, content in mass % of a corresponding element is substituted for each symbol of an element in Formula (1).

2. The steel material according to claim 1, wherein the chemical composition has, in mass %:
Ca: 0.0001 to 0.0100%, and/or
Mg: 0.0001 to 0.0100%, and/or
Zr: 0.0001 to 0.0100%, and/or
rare earth metal: 0.0001 to 0.0100%.

3. The steel material according to claim 1, wherein the chemical composition has, in mass %:
Cu: 0.02 to 0.50%, and/or
Ni: 0.02 to 0.50%.

4. The steel material according to claim 1, wherein the chemical composition has, in mass %:
Co: 0.02 to 0.50%, and/or
W: 0.02 to 0.50%.

5. The steel material according to claim 1, wherein the steel material is an oil-well steel pipe.

6. The steel material according to claim 1, wherein the steel material is a seamless steel pipe.

7. The steel material according to claim 2, wherein the chemical composition has, in mass %:
Cu: 0.02 to 0.50%, and/or
Ni: 0.02 to 0.50%.

8. The steel material according to claim 2, wherein the chemical composition has, in mass %:
Co: 0.02 to 0.50%, and/or
W: 0.02 to 0.50%.

9. The steel material according to claim 3, wherein the chemical composition has, in mass %:
Co: 0.02 to 0.50%, and/or
W: 0.02 to 0.50%.

10. The steel material according to claim 7, wherein the chemical composition has, in mass %:
Co: 0.02 to 0.50%, and/or
W: 0.02 to 0.50%.

* * * * *